US005958157A

United States Patent [19]

Crow et al.

[11] Patent Number: 5,958,157

[45] Date of Patent: Sep. 28, 1999

[54] MAGNETIC MULTIPOLE REDIRECTOR OF MOVING PLASMAS

[75] Inventors: James T. Crow, Albuquerque; Gary R. Mowrer, Cedar Crest, both of N.Mex.

[73] Assignee: Sandia Corporation, Albuquerque, N.Mex.

[21] Appl. No.: 08/718,049

[22] Filed: Sep. 11, 1996

[51] Int. Cl.[6] ..... H05H 1/10

[52] U.S. Cl. ..... 148/565; 219/121.54; 219/121.59; 315/111.41

[58] Field of Search ..... 148/565, 566; 427/571; 315/111.41; 219/121.54, 121.56, 121.59

[56] References Cited

U.S. PATENT DOCUMENTS

| | | | |
|---|---|---|---|
| 3,916,034 | 10/1975 | Tsuchimoto | 427/571 |
| 4,471,003 | 9/1984 | Cann | 219/121.59 |
| 4,952,843 | 8/1990 | Brown et al. | 315/111.41 |
| 5,043,554 | 8/1991 | Kohsaka et al. | 219/121.54 |
| 5,082,542 | 1/1992 | Moslehi et al. | 315/111.41 |
| 5,514,229 | 5/1996 | Parkansky et al. | 148/566 |
| 5,751,113 | 5/1998 | Yashnov et al. | 315/111.41 |
| 5,767,627 | 6/1998 | Siniaguine | 315/111.41 |

OTHER PUBLICATIONS

Limpaecher, R., et al., "Magnetic Multipole Containment of Large Uniform Collisionless Quiescent Plasmas," *Rev. Sci, Instrum.,* vol. 44, No. 6, pp. 726–731 (Jun. 1973).

Crow, J.T., et al., "High Performance, Low Energy Ion Source," *IEE Trans. On Plasma Sci.,* vol. PS–6, No. 4, pp. 535–538 (Dec. 1978).

*Primary Examiner*—George Wyszomierski
*Attorney, Agent, or Firm*—Gregory Cone

[57] ABSTRACT

A method and apparatus for redirecting moving plasma streams using a multiple array of magnetic field generators (e.g., permanent magnets or current bearing wires). Alternate rows of the array have opposite magnetic field directions. A fine wire mesh may be employed to focus as well as redirect the plasma.

14 Claims, 3 Drawing Sheets

B–field reflects plasma electrons, resultant electric potential reflects ions

MAGNETIC MULTIPOLE REDIRECTOR OF MOVING PLASMAS

GOVERNMENT RIGHTS

The Government has rights to this invention pursuant to Contract No. DE-AC04-94AL85000 awarded by the U.S. Department of Energy.

BACKGROUND OF THE INVENTION

1. Field of the Invention (Technical Field)

The present invention relates to apparatuses and methods for deflecting the course of moving plasmas.

2. Background Art

Plasma streams are useful in a number of areas. For example, plasma can be inserted into transmission lines to beneficial effect. However, if such insertion is done by a plasma gun, high power pulses traveling down the line can damage the plasma gun.

It is useful to be able to redirect the course of a plasma at some desired angle. For example, such redirection is useful to insert plasma into a transmission line with lowered risk to the source of the plasma. Devices within which plasma containment, but not redirection, occurs include those disclosed in Limpaecher, et al., "Magnetic Multipole Containment of Large Uniform Collisionless Quiescent Plasmas", *Rev. Sci. Instrum. 44:6, 726–31* (June 1973), and Crow, et al., "High Performance, Low Energy Ion Source", *IEEE Transactions on Plasma Science PS*-6:4, 535–38 (December 1978). These devices describe plasma confinement devices in which the plasmas are stationary. The plasma boundaries would move outward by diffusion if the confining magnetic walls were not there, and the center of the mass is stationary, not moving. The present invention provides an apparatus and method for redirecting moving plasmas.

SUMMARY OF THE INVENTION (DISCLOSURE OF THE INVENTION)

The present invention is of an apparatus for and method of redirecting a moving plasma stream from a plasma source, comprising: providing an array of magnetic field generators; positioning the plasma source to direct the moving plasma stream at the array; and causing the plasma source to generate the moving plasma stream, whereby the moving plasma stream is at least in part redirected by the array. In the preferred embodiment, the array is of magnetic field generators for which alternate rows generate a magnetic field of substantially opposite direction, the array generates an electric sheath potential, and the array is of permanent magnets having a field strength of at least approximately 3.5 kG or of wires in which current direction is opposite in alternate wires. In the wire embodiment, the neutral particles in the moving plasma stream pass through the array. The array may be curved (preferably a curved fine wire mesh) and used for focusing the redirected part of the moving plasma stream. The redirected plasma may be used to act as a plasma opening switch, for surface melting or welding of surfaces, for treating surfaces by depositing a desired material thereon, for etching material from a surface, for modifying characteristics of a surface, for enhancing surface hardness and smoothness in metals, for enhancing toughness and strength by elimination of surface cracks and defects, and to insert plasma into a power line.

A primary object of the present invention is to provide a straightforward and flexible means by which plasmas may be steered or redirected.

A primary advantage of the present invention is that focusing as well as redirection may be performed.

Another advantage of the present invention is that neutral particles can be permitted to pass through the redirection apparatus, if that feature is desired, rather than impacting on the apparatus.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings:

FIG. 3(*b*) is more likely, because it allows the plasma gun, beam plasma, and the magnets to all be at the same (ground) potential;

DESCRIPTION OF THE PREFERRED EMBODIMENTS (BEST MODES FOR CARRYING OUT THE INVENTION)

The present invention is of apparatuses and methods for redirecting (or reflecting) moving plasmas. The redirection is preferably performed by an array of magnets (preferably permanent) or wires generating opposite magnetic fields in a sheath region in alternating members of the array. If wires are employed, neutral particles simply pass through (in most cases) the apparatus.

Figure 1:
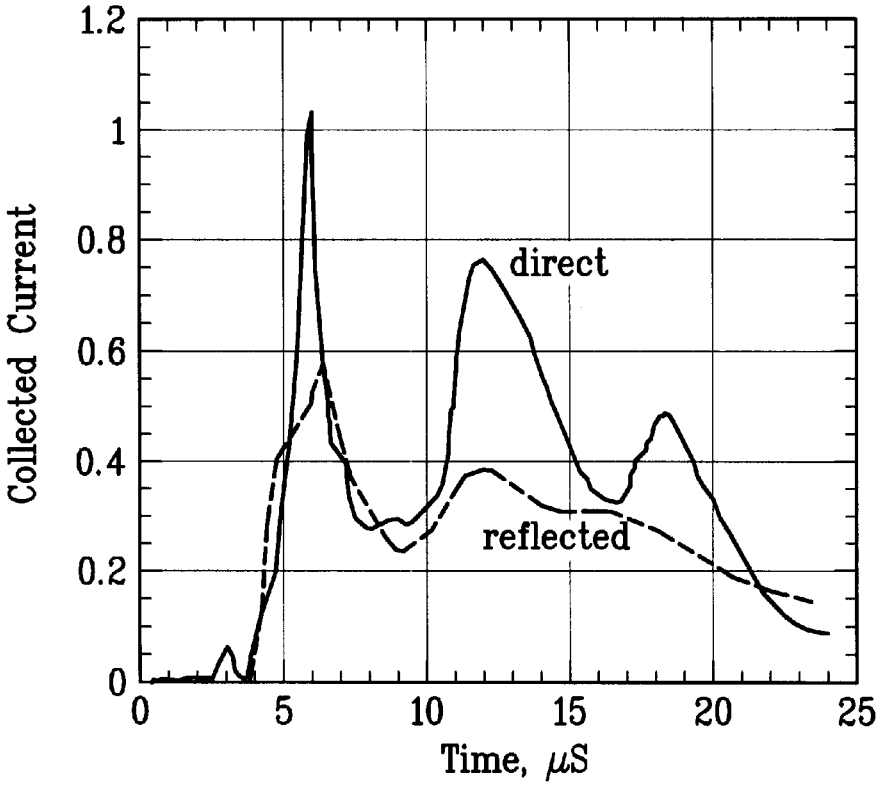
FIG. 1 is a graph of ion current collected with (dashed) and without (solid) redirection with a transport distance of 30 cm.
Figure 2:
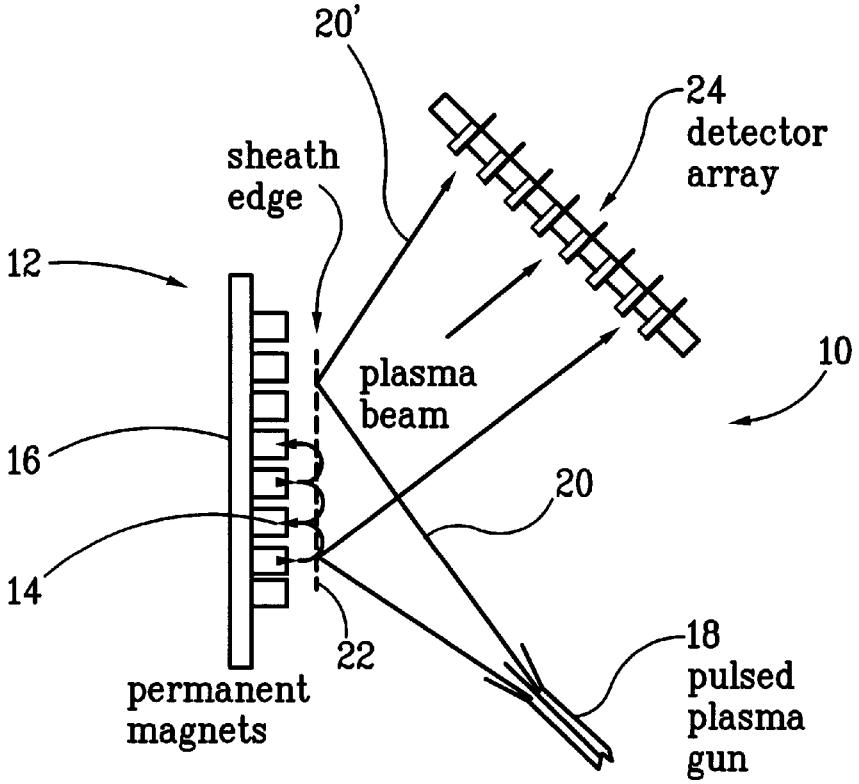
FIG. 2 illustrates the magnet array embodiment of the present invention.

In the first, magnet, embodiment of the invention, a planar array of permanent magnets may be used as a mirror to change the direction of propagation of a burst of plasma, such as emitted from an electric plasma gun. The array of magnets may be positioned at an angle of 45° to the direction of the plasma motion and a set of detectors placed to measure the reflected plasma, as shown in FIG. 2. The reflection efficiency is dependent on magnet geometry, but can be as great as at least 50%. Pulse shape in the reflection is maintained with some change to the slower components, and plasma transport speed appears essentially unchanged by the reflection. Representative detected waveforms are shown in FIG. 1 for plasma pulses with and without redirection. Plasma transport distance was the same (30 cm) in both cases. The detectors were charge collectors (Faraday cups) arranged in a square array and biased to repel electrons and collect positive ions.

Referring to the FIG. 2 embodiment of the plasma redirector 10 of the invention, the magnet array 12 (preferably two-dimensional) may be composed of permanent magnets 14 aranged in rows of alternating field orientation ("picket fence" geometry). In tests of the embodiment, a 9 mm baseplate 16 was employed. Plasma source 18 directs plasma beam 20 against sheath edge 22, causing redirection of beam 20', such as against detector array 24 (or other desired target). Three sets of magnets were tested: The first measured 1.5 kG at the magnet faces when arranged in the array, the second set measured 3.5 kG, and the third set measured 5.2 kG. The magnet rows were spaced 1.5 mm edge-to-edge, with the center-to-center distance about 1.1 cm for the strongest magnets. Reflection improved with increased field strength, markedly in the change from 1.5 kG to 3.5 kG magnets.

Figure 3A:
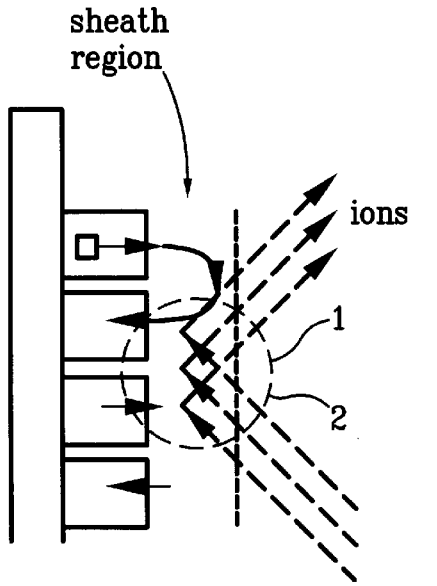
FIGS. 3(*a*), 3(*b*), and 3(*c*) illustrate, for the embodiment of FIG. 2, two possible variations of the electric potential in the sheath region between the magnets and the beam plasma.
Figure 3B:
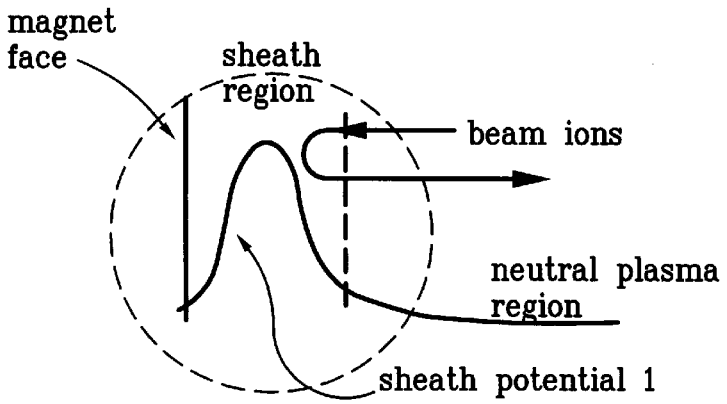
Figure 3C:
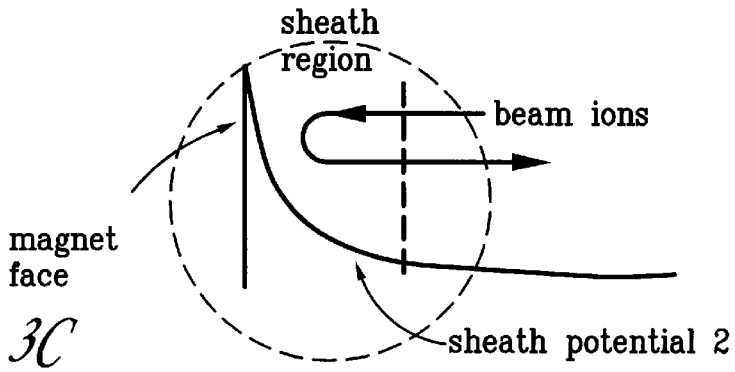

While the plasma mirror of the invention may be described as magnetic, the magnetic fields are not strong enough in and of themselves to deflect the ions. Electrons are co-moving with the plasma ions to maintain charge and current neutrality, and these electrons are stopped by the magnetic field, producing (it is believed), an electric sheath potential that reflects the fast plasma ions. Two possible sheath electrical potential profiles are illustrated in FIGS. 3(*a*)–(*c*). The profile of FIG. 3(*b*) is more probable, because the magnet assembly remains at ground potential with the beam plasma also at ground potential. The profile of FIG. 3(*c*) requires that the ions be born at a potential much less than the magnet potential, which is possible if there is a plasma bridge between the reflector and the plasma gun.

Figure 4:
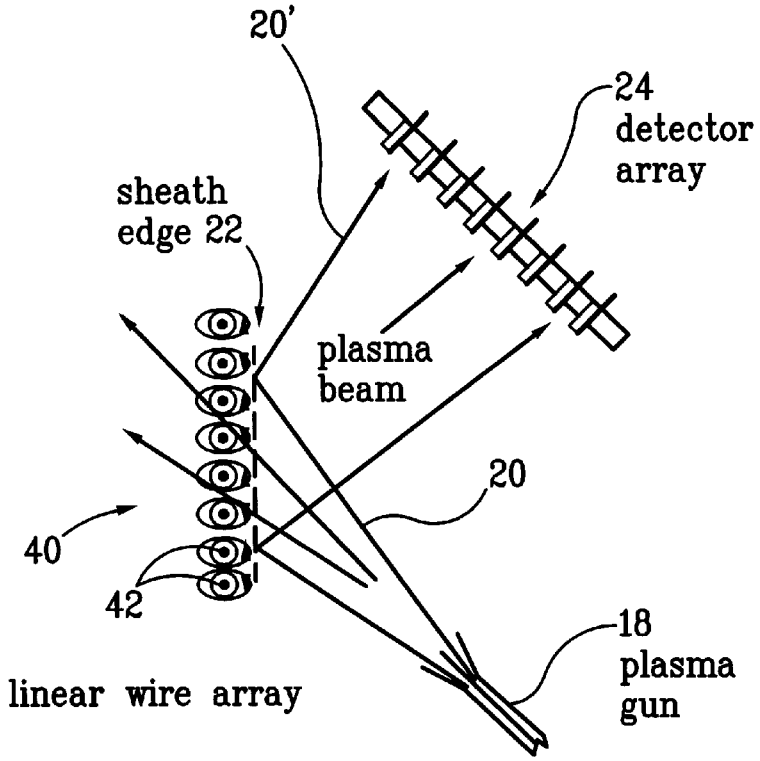
FIG. 4 illustrates an embodiment of the invention wherein picket fence magnetic fields are produced by a linear wire array with currents is opposite directions in alternating wires.

The picket fence magnetic field configuration can also be produced by current in a wire array, as shown in FIG. 4. The currents in the wires 42 in the array 40 alternate in direction from wire to wire, producing a magnetic field very similar to the permanent magnet array 12 of FIG. 2. The wire currents may be constant in time (direct current (DC)), pulsed, or regularly time-varying (alternating current (AC)), depending on the application. An important advantage of the wire array is its transparency, which allows neutral particles to pass through without either reflecting or stagnating against a solid surface.

Figure 5:
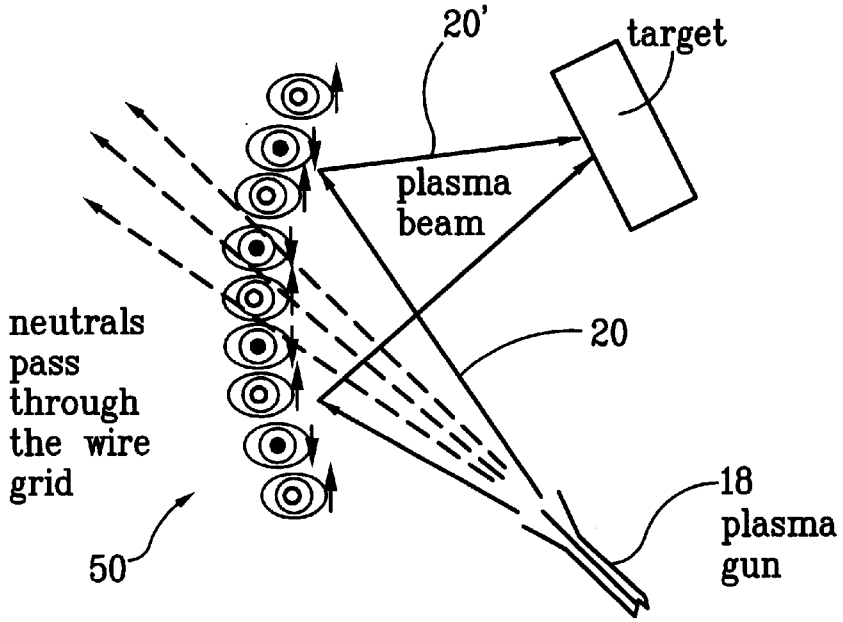
FIG. 5 illustrates a very fine mesh wire array of the invention used to focus the redirected plasma beam.

If the array scale length (wire-to-wire spacing) is made sufficiently fine, so that the reflection is nearly specular, the plasma redirector of the invention can be a focusing reflector 50, as shown in FIG. 5. A permanent magnet array is believed not to work as well in focusing due to the "roughness" of the reflector. A close analogy is curving a matte finish surface, which does not change light reflection appreciably. A wire array with close wire spacing is comparable to a polished surface.

If an ion beam is not charge and current neutralized (it may be both, either, partially either, partially both (which is usual), or both), it will be limited in the distance it may propagate, or in the intensity of the beam that may be used. A beam that is not charge neutralized will eventually expand because of electric repulsion forces between the ions. An ion beam may be charge neutralized either by co-moving electrons in which case it is (usually) current neutralized and is indistinguishable from a moving plasma, or the ion beam may be charge neutralized by stationary electrons, for example those in a stationary plasma through which the ion beam propagates. An ion beam that is not current neutralized tends to be disrupted by magnetic forces.

Useful applications of the plasma redirector of the present invention include in plasma opening switches for high-power accelerators. Plasma switches operate by injecting a burst of plasma into the accelerator transmission line, where it temporarily short-circuits the power flowing in the line. The currents flowing in the plasma remove the plasma from the line in times dependent on the plasma density and volume. These times can be adjusted to be short for simple removal of prepulse from the main power pulse or for pulse sharpening, or longer, to provide energy storage in the inductance of the transmission line. The redirector configuration of the invention offers advantages of durability and reliability particularly over the complex magnetic guiding systems now in use in many accelerators.

The plasma redirector of the invention also has applications in other types of high-intensity neutral plasma guiding. Ion beams that are not charge and current neutralized are difficult to transport, because electric and magnetic forces disrupt the beam. Ion (or electron) beams that are neutralized are difficult to guide and turn, because turning intense neutralized beams with externally applied electric and magnetic fields is complex and difficult. The plasma redirector herein is useful in transporting and steering higher intensity ion beams than are possible now in applications such as surface heating and treatment, or ion implantation. With the focusing embodiment of the invention, very high beam intensity at the target may be achieved without the need to generate and transport high intensity plasma streams. This is useful in surface melting or welding of metals and/or nonmetals.

Ion beams are also used to treat semiconductor wafers and other materials by depositing a desired material on or in the subject surface (usually using a broad beam), or by etching material from the surface (usually using a focused beam). Electron beams are also used for surface etching. Very high intensity ion beams are used to modify the characteristics of surfaces by producing rapid heating in a thin layer, which very rapidly cools by conduction in the material. These changes include enhanced surface hardness and smoothness in metals, and enhanced toughness and strength in many materials by elimination of surface cracks and defects.

The multipole plasma redirector of the invention has advantages and applications in all of these areas because the charge and current neutralization characteristics of the moving plasma are such that it expands only by thermal (collisional) processes, and not because of electric and magnetic forces that increase rapidly with beam charge and current density. This means that it is possible to apply a higher flux of ions to a surface with consequent faster processing. The elimination of neutrals from the beam in the wire-based embodiment may also be an advantage in the above applications by reducing contamination in the beam and by reducing or eliminating secondary effects produced by the usually slower neutrals. There also can be charge exchange processes in the ion beam that during transit will convert ions to neutrals. The redirection process of the invention may also be useful geometrically, both in protecting the plasma source or gun, and in folding the system, much as a prism in binoculars does, for compactness.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of redirecting a moving plasma stream from a plasma source, the method comprising the steps of:

a) providing a multipole array of magnetic field generation means situated to intercept a moving plasma stream;

b) positioning the plasma source to direct the moving plasma stream against the array, and c) causing the plasma source to generate the moving plasma stream, whereby the moving plasma stream is at least in part reflected by the array towards an intended target.

2. The method of claim 1 wherein the step of providing an array comprises providing an array of magnetic field generation means for which alternate rows generate a magnetic field of substantially opposite direction.

3. The method of claim 1 wherein the step of providing an array comprises providing an array which generates an electric sheath potential.

4. The method of claim 1 wherein the step of providing an array comprises providing an array of permanent magnets.

5. The method of claim 4 wherein the step of providing an array comprises providing an array having a field strength of at least approximately 3.5 kG.

6. The method of claim 1 wherein the step of providing an array comprises providing an array of wires.

7. The method of claim 6 wherein the step of providing an array comprises providing an array of wires in which current direction is opposite in alternate wires.

8. The method of claim 6 wherein the step of causing the plasma source to generate the moving plasma stream comprises allowing neutral particles in the moving plasma stream to pass through the array.

9. The method of claim 1 wherein the step of providing an array comprises providing a curved array.

10. The method of claim 9 wherein the step of providing an array comprises providing a curved fine wire mesh.

11. The method of claim 9 wherein the step of causing the plasma source to generate the moving plasma stream comprises focusing the reflected part of the moving plasma stream.

12. The method of claim 1 additionally comprising the step of employing the reflected plasma to perform an action selected from the group consisting of acting as a plasma opening switch, surface melting or welding of surfaces, treating surfaces by depositing a desired material thereon, etching material from a surface, enhancing surface hardness and smoothness in metals, enhancing toughness and strength by elimination of surface cracks and defects, and inserting plasma into a power line.

13. The method of claim 1 wherein the array is in the form of a planar surface.

14. The method of claim 1 wherein the array is in the form of a non-closed, curved surface capable of focussing the plasma stream onto the target.

* * * * *